US005842492A

United States Patent [19]

Lee

[11] Patent Number: 5,842,492

[45] Date of Patent: Dec. 1, 1998

[54] APPARATUS FOR DISPERSING WASHING WATER OF A DISHWASHER

[75] Inventor: Jae-Yoll Lee, Kyungki-Do, Rep. of Korea

[73] Assignee: Daewoo Electronics Co., Ltd., Rep. of Korea

[21] Appl. No.: 866,067

[22] Filed: May 30, 1997

[30] Foreign Application Priority Data

Jun. 14, 1996 [KR] Rep. of Korea ..... 1996 15875

[51] Int. Cl.[6] ..... A47L 15/23

[52] U.S. Cl. ..... 134/176; 134/179

[58] Field of Search ..... 134/172, 176, 134/179, 180, 181, 191

[56] References Cited

U.S. PATENT DOCUMENTS 4,784,168 11/1988 Erminio .
5,464,482 11/1995 Michael et al. ..... 134/172 X

FOREIGN PATENT DOCUMENTS 1 286 820 8/1972 United Kingdom .
1 486 582 9/1977 United Kingdom .

*Primary Examiner*—Philip R. Coe
*Attorney, Agent, or Firm*—Cushman Darby & Cushman Intellectual Property Group of Pillsbury Madison & Sutro, LLP

[57] ABSTRACT

Disclosed is an apparatus for dispersing a washing water of a dishwasher comprising a dispersing nozzle arm rotatably connected to a pump which supplies the washing water, nozzle bodies rotating the dispersing nozzle arm and sliding along an outer circumference surface of the dispersing nozzle arm, and a guiding part which is installed on a bottom wall of the dishwasher, for sliding the nozzle bodies along the outer surface of the spraying nozzle arm. The dispersing nozzle arm is rotated by ejecting forces of washing water which is ejected from the nozzle bodies. The nozzle bodies move along a guide rail while sliding along the outer circumference surface of the spraying nozzle arm. Since the nozzle bodies slide on the outer surface of the spraying nozzle arm and evenly disperse the washing water to corners of a washing tank, and the dishwasher can effectively wash dishes, thereby preventing the waste of the washing water.

5 Claims, 6 Drawing Sheets

APPARATUS FOR DISPERSING WASHING WATER OF A DISHWASHER

BACKGROUND OF THE INVENTION

1. Field of the Invention

The presentinvention relates to a dishwasher, and more particularly to an apparatus for dispersing washing water of a dishwasher.

2. Description of the Prior Art

Dishwashers are generally used to promptly wash kinds of utensils such as glasses, cups, dishes, and bowls or the like which are used in eating and/or drinking places. A dishwasher includes a reservoir in which wash liquid or washing water is stored, a washing tank in which is installed a basket in which utensils are placed, and at least one nozzle arm for dispersing the washing water to the utensils. The nozzle arms are provided with a plurality of nozzles which disperse the washing water or detergent, and the nozzle arms rotate when the washing water is dispersed.

A conventional dishwasher is shown in FIG. 1, which is disclosed in U.S. Pat. No. 4,784,168 issued to Dall'Oglio Erminio on Nov. 15, 1988 and entitled "Open Washing Cycle Dishwashing Machine".

As shown in FIG. 1, the dishwasher 10 of Erminio includes a basket or cage 12 in which utensils are placed, a wash tank 14 in which the cage 12 is installed, a lid 16 for covering the wash tank 14, a first spray nozzle arm 18, and a second spray nozzle arm 20 which is rotatably mounted to the lid 16 and sprays the washing water and the detergent.

The first and second spray nozzle arms 18 and 20 are connected to a pump (not shown) for supplying the washing water and the detergent, and are provided with a plurality of spray nozzles, respectively. The first and second spray nozzle arms 18 and 20 are rotated by the pressure of the washing water, which is in the range of 2 and 3 atm, and then spray the wash liquid through the nozzles.

However, the dishwasher 10 of Erminio, as shown in FIG. 2, cannot distribute the wash liquid to an area between the center portion CP and the corners CN of the wash tank 14 even though the spray angles of the spray nozzles are adjusted. Moreover, the utensils in the cage 12 have different shapes and cannot be set in the basket 12 with respect to the first and second spray nozzle arms 18 and 20 under a same condition, so the utensils may not be washed uniformly.

A dishwasher which is designed to overcome the above-mentioned problems of the dish washer 10 of Erminio is disclosed in U.S. Pat. No. 4,993,444 issued to Tateo Toriyama et al. on Feb. 19, 1991 entitled "Dishwasher". FIGS. 3 and 4 show the dishwasher 50 of Toriyama, which includes a nozzle body 60.

As shown in FIGS. 3 and 4, the nozzle body 60 of Toriyama is installed between a cage 52 and a bottom wall 54. The bottom wall 54 is connected to a pump 56 so that wash liquid which is collected on the bottom wall 54 is circulated by the pump 54. The nozzle body 60 of Toriyama is connected to the pump 56 by a connection tube 57 and slidably mounted to a water conduit 58 through which the washing water is introduced.

A plurality of spray apertures 62 are formed on the upper surface of the nozzle body 60, and the wash liquid supplied from the water conduit 58 is dispersed through the spray apertures 62. The washing water is sprayed while the nozzle body 60 slide along the water conduit 58 by a pinion 64 located on a lower portion thereof.

However, the nozzle body 60 of Toriyama has some disadvantages in that since it needs a motor 66 and a pinion

64 for reciprocal movement of the nozzle body 60 and a support member for supporting the water conduit 58, its structure is complicated. Further, since portions along the water conduit 58 on which the nozzle body 60 slides should be precisely machined in order to prevent leakage of the liquid therefrom due to the high pressure of the water, the machining of the nozzle body 60 is time-consuming and expensive.

SUMMARY OF THE INVENTION

Accordingly, it is an object of the present invention to provide a washing water dispersing apparatus of a dishwasher capable of distributing washing water to corners of a wash tank of the dishwasher and having a construction.

To accomplish the above object of the present invention, there is provided a washing water dispersing apparatus of a dishwasher comprising:

a dispersing nozzle arm including a connecting conduit rotatably connected to a pump for supplying a washing water, and a plurality of dispersing apertures which are formed on an outer circumference surface thereof and arranged in longitudinal direction thereof, both ends of the dispersing nozzle arm being opened so that the washing water is dispersed through the dispersing apertures;

a first nozzle body, into which an end of the dispersing nozzle arm is inserted, including a plurality of first assistance spray apertures formed on an outer circumference surface thereof, a first connecting protrusion opposite to the first assistance spray apertures, and a first jet aperture formed on the outer circumference surface between the first assistance spray apertures so that the washing water is ejected from the first jet aperture and the ejection of the washing water rotates the dispersing nozzle arm, the first nozzle body sliding on the outer circumference surface of the dispersing nozzle arm;

a second nozzle body, into which other end of the dispersing nozzle arm is inserted, including a plurality of second assistance spray apertures formed on an outer circumference surface thereof, a second connecting protrusion opposite to the second assistance spray apertures, and a second jet aperture formed on the outer circumference surface between the second assistance spray apertures so that the washing water is ejected from the second jet aperture and the ejection of the washing water from the second jet aperture rotates the dispersing nozzle arm in coperation with the ejection of the washing water from the first jet aperture, the second nozzle body sliding on the outer circumference surface of the dispersing nozzle arm; and a guide part for sliding the first and second nozzle bodies on the outer circumference surface in the lengthwise direction of the dispersing nozzle arm when the dispersing nozzle arm rotates, the means being installed on a bottom wall of the dishwasher.

The guide part includes a guide rail installed on a bottom wall of the dishwasher and a pair of followers for sliding the first and second nozzle bodies along the dispersing nozzle arm.

The first and second jet apertures are formed in opposite directions with respect to each other. The first and second nozzle bodies are slid on the outer circumference surface of the dispersing nozzle arm by the ejection of the washing water from the first and second jet apertures and rotated along the guide rail so that the dispersing nozzle arm and the first and second nozzle bodies disperse the washing water toward dishes, thereby dispersing the washing water evenly to corner areas of the dishwasher.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Figure 1:
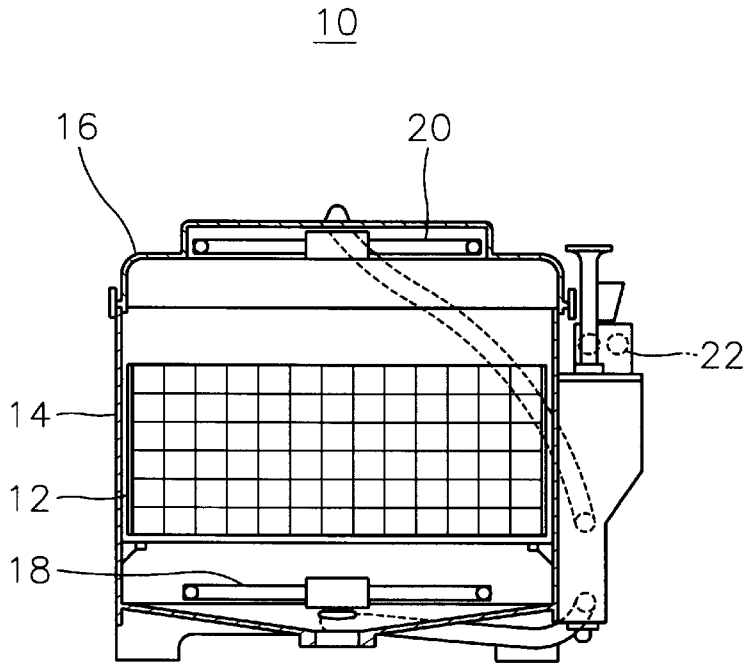
FIG. 1 (PRIOR ART)
FIG. 1 is a cross-sectional view of a conventional dishwasher including a rotary dispersing nozzle assembly.
Figure 2:
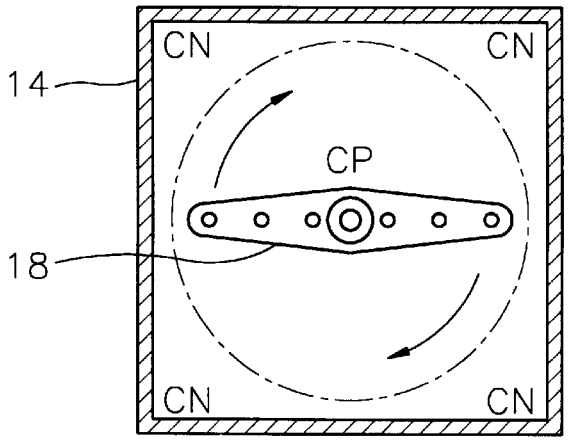
FIG. 2 (PRIOR ART)
FIG. 2 is a drawing for illustrating a dispersing area of washing water by the rotary dispersing nozzle assembly in FIG. 1.
Figure 3:
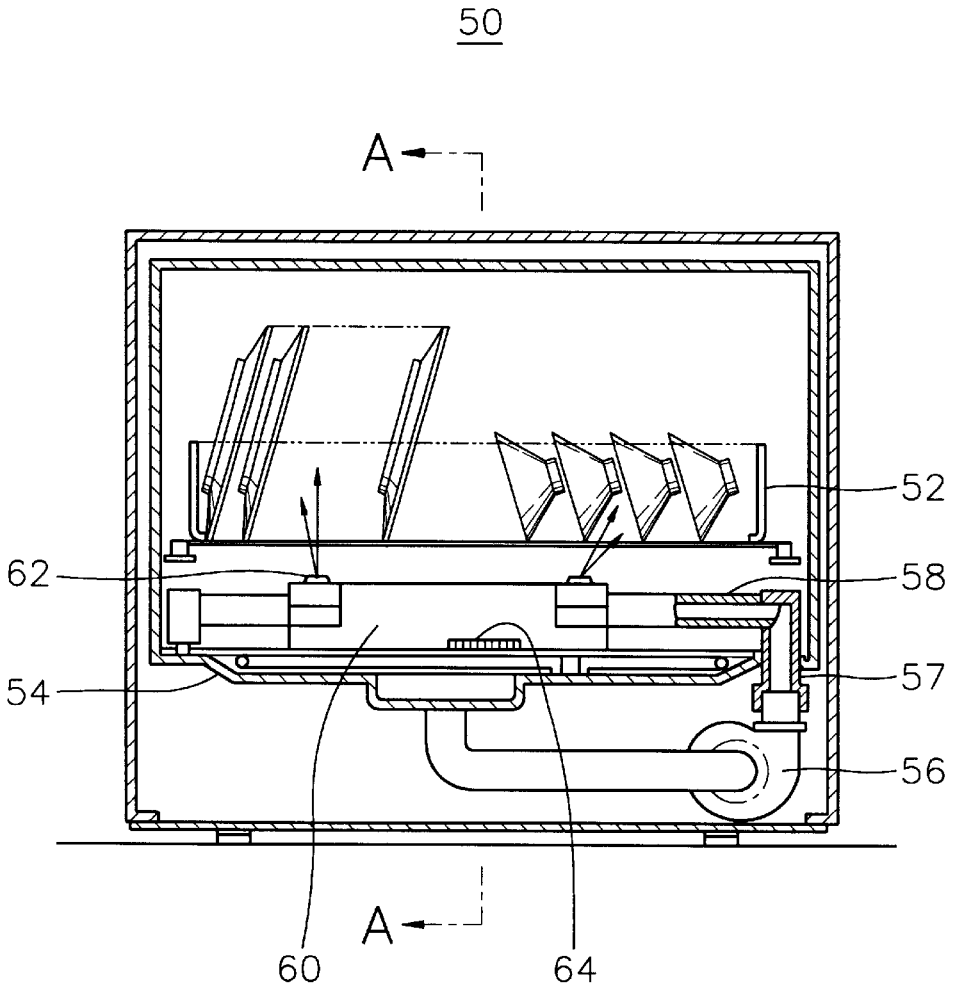
FIG. 3 (PRIOR ART)
FIG. 3 is a cross-sectional view of a conventional dishwasher including a different type dispersing nozzle assembly.
Figure 4:
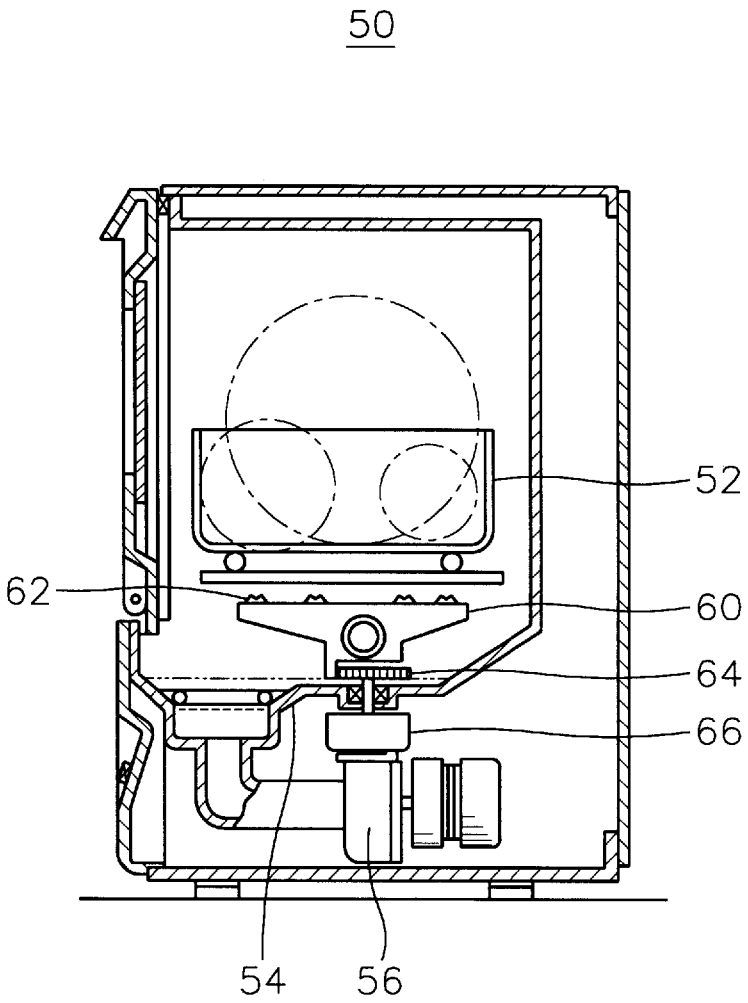
FIG. 4 (PRIOR ART)
FIG. 4 is a cross-sectional view taken along the line A—A line in FIG. 4.

Hereinafter, the preferred embodiments of the present invention will be explained in more detail with reference to the accompanying drawings. In the drawings, the same marks are given to the same components.

Figure 5:
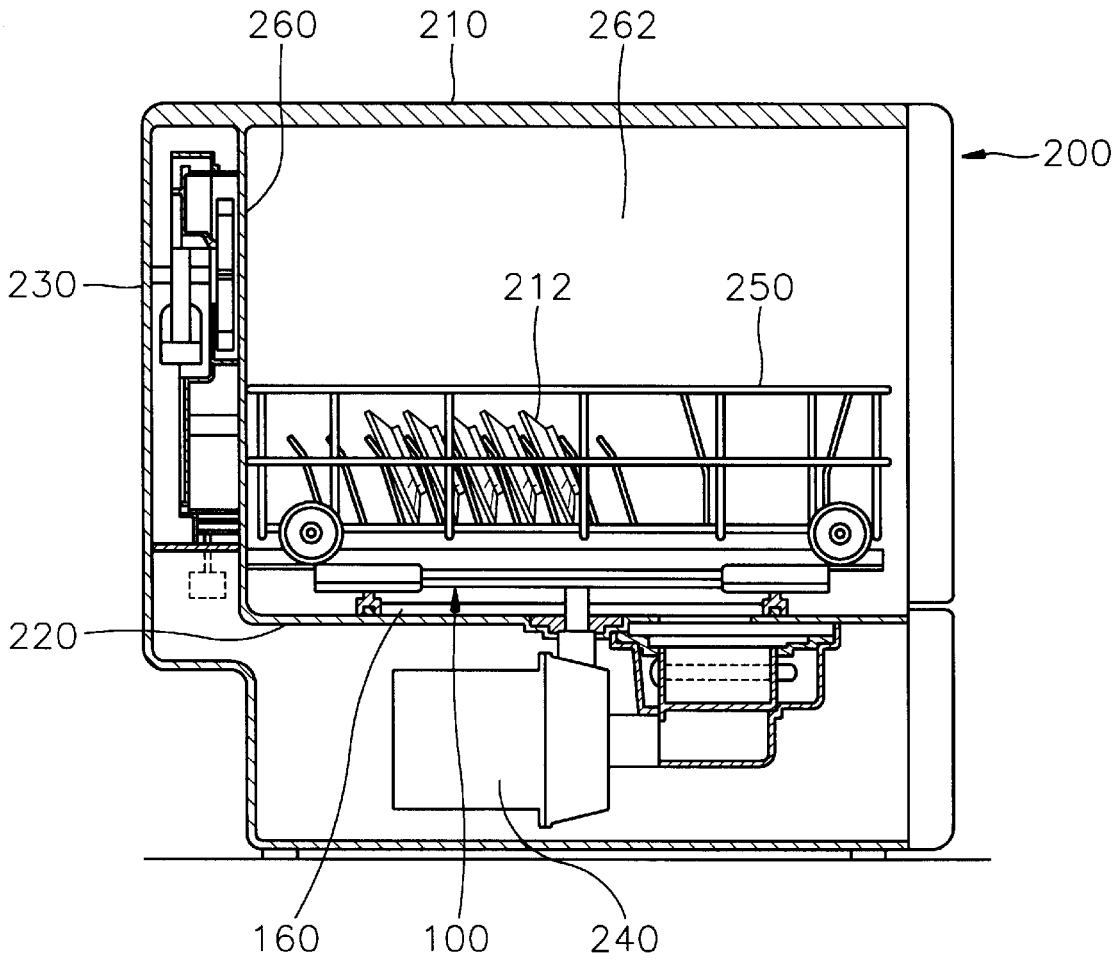
FIG. 5 is a cross sectional view of a dishwasher utilizing an apparatus for dispersing washing water according to the present invention.

FIG. 5 is a drawing for showing a dishwasher 200 utilizing a washing water dispersing apparatus 100 of a dishwasher according to the preferred embodiment of the present invention. As shown in FIG. 5, the dishwasher 200 comprises a housing 210, a cage 250 into which utensils 212 are placed, an inner wall 260 for forming washing tank 262 in which the utensils 212 are washed, a bottom wall 220 which is connected to an lower portion of the inner wall 260 into which the cage 250 is placed, a door 230 for opening/closing the washing tank 262, and a pump for supplying washing water for washing the utensils 212. The washing water dispersing apparatus 100 of a dishwasher according to the preferred embodiment of the present invention is installed between the bottom wall 220 and the cage 250 and is rotatably connected to the pump 240.

Figure 6:
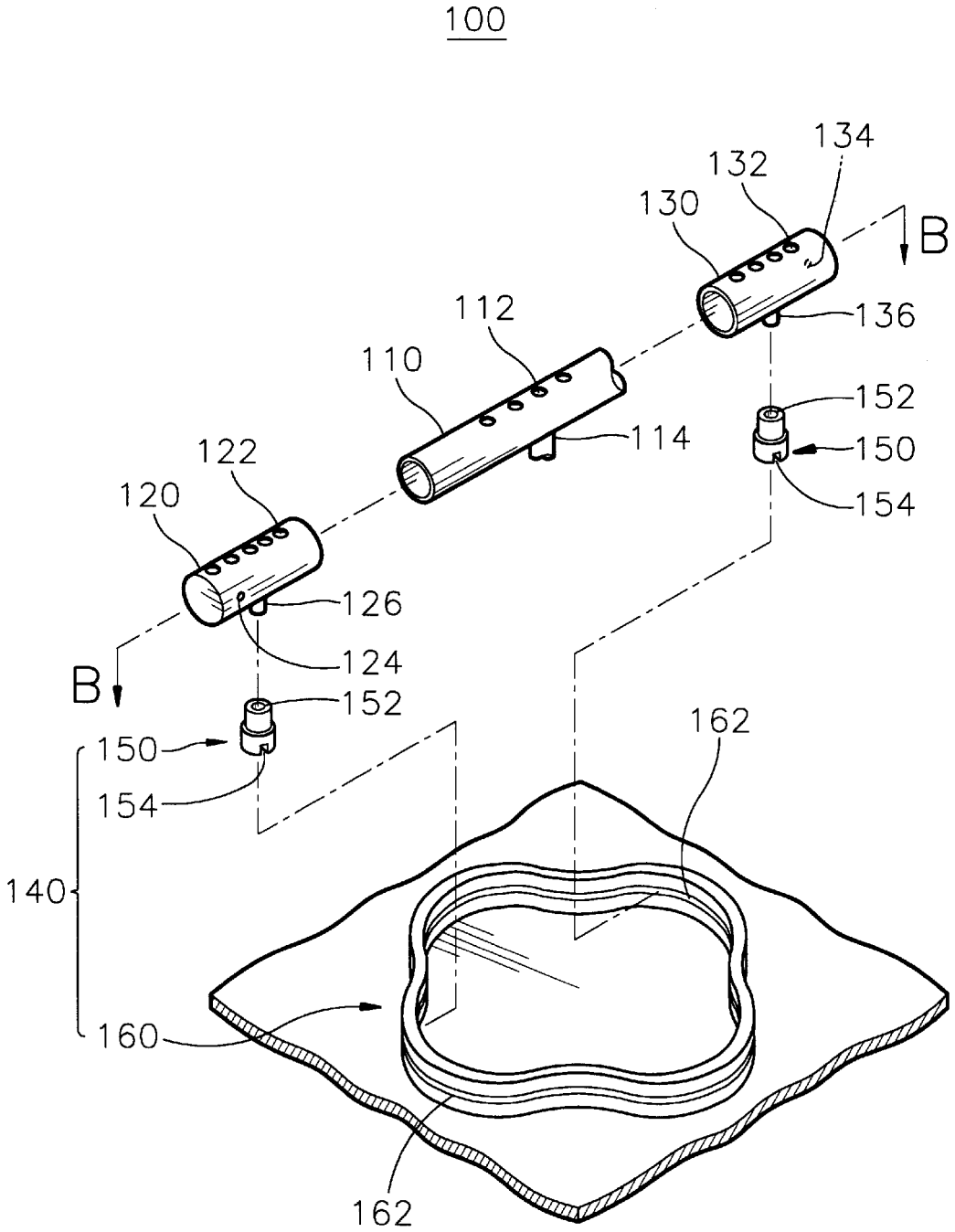
FIG. 6 is an exploded schematic view of the apparatus for dispersing washing water according to the present invention.

FIG. 6 is an exploded schematic view of the washing water dispersing apparatus 100. In FIG. 6, the washing water dispersing apparatus 100 of a dishwasher according to the preferred embodiment of the present invention comprises a dispersing nozzle arm 110 having open sides, a first nozzle body 120 into which the dispersing nozzle arm 110 is slidably inserted for rotating the dispersing nozzle arm 110, and which has an open end, a second nozzle body 130 into which the dispersing nozzle arm 110 is slidably inserted for rotating in cooperation with the first nozzle body 120, and which has an open end, and a sliding part 140 installed on the bottom wall 220 for sliding the first and second nozzle bodies 120 and 130 on outer circumferenct surface of the dispersing nozzle arm 110 when the dispersing nozzle arm 110 is rotated.

The dispersing nozzle arm 110 includes a connecting conduit 114 and a plurality of spray apertures 112 for dispersing the washing water supplied from the pump 240, the plurality of spray apertures 112 being arranged on the outer circumference surface thereof in the longitudinal direction thereof opposite to the connecting conduit 114 of the dispersing nozzle arm 110. The dispersing nozzle arm 110 has a T-shape and open sides, disperses the washing water, and is rotated when the washing water is supplied by the pump 240.

The open sides of the dispersing nozzle arm 110 are inserted into the first and second nozzle bodies 120 and 130, and the first and second nozzle bodies 120 and 130 slide along the outer circumference surface of the dispersing nozzle arm 110 while the dispersing nozzle arm 110 rotates. The first nozzle body 120 includes a first connecting protrusion 126 and a plurality of first assistance spray apertures 122, the first connecting protrusion 126 being connected with the sliding part 140, and includes the plurality of the first assistance spray apertures 122 formed on the outer circumference surface thereof opposite to the first connecting protrusion 126 of the first nozzle body 120 in the same direction as the dispersing apertures 112. The first nozzle body 120 is provided with a first jet apertures 124 formed between the first assistance apertures 122 and the first connecting protrusion 126, the washing water supplied from the pump 240 being ejected through the first jet aperture 124, the ejection of the washing water through the first jet apertures 124 applying a rotating force to the dispersing nozzle arm 110.

The second nozzle body 130 includes a second connecting protrusion 136 and a plurality of second assistance spray apertures 132, the second connecting protrusion 136 being connected with the sliding part 140, and includes the plurality of the second assistance spray apertures 132 formed on the outer circumference surface thereof opposite to the second connecting protrusion 136 of the second nozzle body 130 in the same direction as the dispersing apertures 112. The second nozzle body 130 is provided with a second jet aperture 134 formed between the second assistance apertures 132 and the second connecting protrusion 136, the washing water supplied from the pump 240 being ejected through the second jet apertures 134, the ejection of the washing water through the second jet aperture 134 applying a rotating force to the dispersing nozzle arm 110, that is the dispersing nozzle arm 110 being rotted by ejection of the washing water via the first and second jet apertures 124 and 134.

The sliding part 140 for sliding the first and second nozzle bodies 120 and 130 along the outer circumference surface of the dispersing nozzle arm 110 comprises a guide rail 160 installed on the bottom wall 220 and a pair of followers 150 for connecting the first and second nozzle bodies 120 and 130 with the guide rail 160.

The pair of followers 150 are provided with a connecting groove 152 formed at a lower portion thereof and a guide slit 154 formed at an upper portion thereof, the first and second connecting protrusions 126 and 136 are inserted into the connecting groove 152 respectively, and the guide rail 160 is inserted into the guide slit 154. The guide slit 154 is provided with a pair of first guide recesses 156 formed on inner surface thereof, and the guide rail 160 is also provided with a pair of second guide recesses 162 formed on both sides of the guide rail 160 to be opposite to the first guide recesses 156 when the guide rail 160 is inserted into the slit 154. A plurality of balls 156 are inserted between the first and second guide recesses 156 and 162 so that the balls 158 reduce friction occurring between the first and second guide recesses 156 and 162 while the pair of the followers 150 move along the guide rail 160.

The operation of a washing water dispersing apparatus 100 of a dishwasher according to the preferred embodiment of the present invention described above, will be explained.

If the pump 250 is driven, the washing water is supplied via the connecting conduit 114 to the interior of the dispersing nozzle arm 110 and to the first and second nozzle bodies 120 and 130. The pressure of the washing water supplied by the pump 240 makes the washing water disperse through the dispersing apertures 112 and the first and second assistance dispersing apertures 122 and 132 toward the dishes 212, and the pressure of ejection of the washing water from the first and second jet apertures 124 and 134 of the first and second nozzle bodies 120 and 130 rotates the dispersing nozzle arm 110 and the first and second nozzle bodies 120 and 130.

Figure 7:
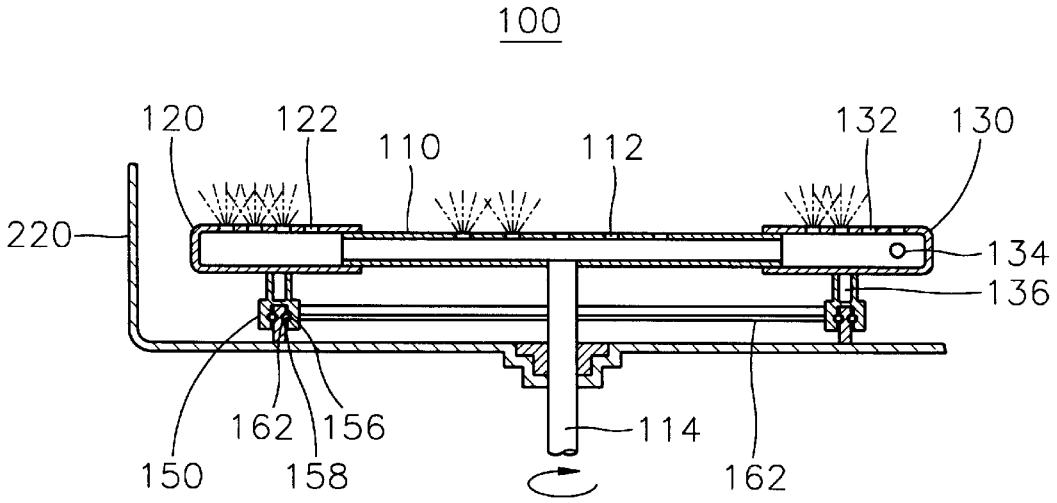
FIG. 7 is a cross-sectional view taken along the line B—B in FIG. 6.
Figure 8:
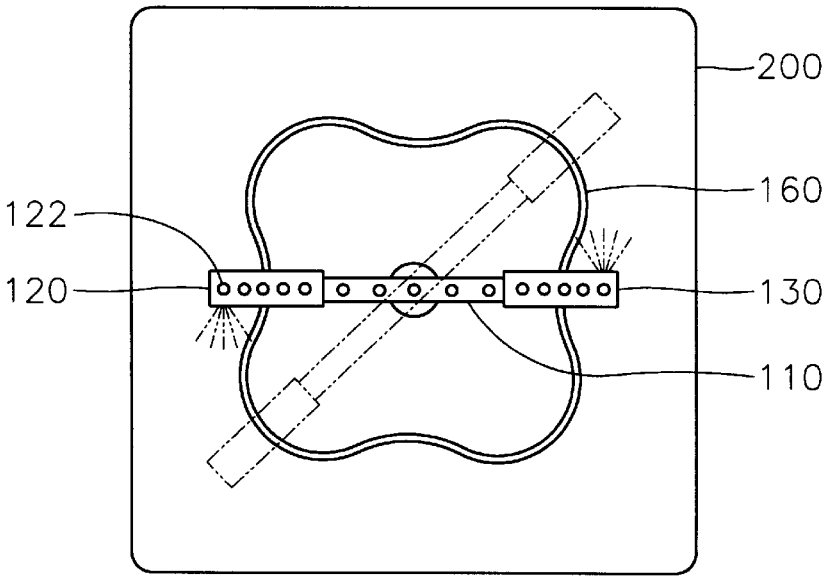
FIG. 8 is a drawing for illustrating operation of an apparatus for dispersing washing water according to the present invention.

At this time, the followers 150 move along the shape of the guide rail 160, and the first and second nozzle bodies 120 and 130 slide along the outer circumference surface of the dispersing nozzle arm 110. Therefore, the dispersing nozzle arm 110 and the first and second nozzle bodies 120 and 130 spray as shown FIGS. 7 and 8 do that the washing water sprays evenly to the corners of the washing tank 262.

As described in the preferred embodiment of the present invention, washing water dispersing apparatus of a dishwasher has a very simple construction, and can disperse the washing water evenly to corner areas of the washing tank of the dishwasher so that dirty dishes can be effectively washed and the washing water can be saved.

Although the preferred embodiment of the invention has been described, it is understood that the present invention should not be limited to the preferred embodiment, but various changes and modifications can be made by one skilled in the art within the spirit and scope of the invention as hereinafter claimed.

What is claimed is:

1. An apparatus for dispersing a washing water of a dishwasher comprising:

a dispersing nozzle arm including a connecting conduit rotatably connected to a pump for supplying a washing water, a plurality of dispersing apertures which are formed on an outer circumference surface thereof and arranged in a longitudinal direction thereof, both ends of said dispersing nozzle arm being opened so that the washing water is dispersed through the dispersing apertures;

a first nozzle body, into which an end of said dispersing nozzle arm is inserted, including a plurality of first assistance spray apertures formed on an outer circumference surface thereof, a first connecting protrusion opposite to the first assistance spray apertures, and a first jet aperture formed on the outer circumference surface between the first assistance spray apertures so that the washing water is ejected from the first jet aperture and the ejection of the washing water rotates said dispersing nozzle arm, and said first nozzle body sliding along the outer circumference surface of said dispersing nozzle arm;

a second nozzle body, into which other end of said dispersing nozzle arm is inserted, including a plurality of second assistance spray apertures formed on an outer circumference surface thereof, and a second connecting protrusion opposite to the second assistance spray apertures, a second jet aperture formed on the outer circumference surface between the second assistance spray apertures so that the washing water is ejected from the second jet aperture and the ejection of the washing water from the second jet aperture rotates said dispersing nozzle arm in cooperation with the ejection of the washing water from the first jet aperture, said second nozzle body sliding along the outer circumference surface of said dispersing nozzle arm;

a means for sliding said first and second nozzle bodies along the outer circumference surface in the lengthwise direction of said dispersing nozzle arm when said dispersing nozzle arm rotates, said means being installed on a bottom wall of said dishwasher.

2. An apparatus for dispersing a washing water of a dishwasher as claimed in claim 1, wherein the first and second jet apertures are formed in opposite directions with respect to each other as to spray the washing water in opposite directions.

3. An apparatus for dispersing a washing water of a dishwasher as claimed in claim 1, wherein said means further comprises:

a guide rail installed on the bottom wall of said dishwasher; and a pair of followers for sliding said first and second nozzle bodies along the outer circumference surface of said dispersing nozzle arm while moving along said guide rail, said pair of followers respectively having a connecting groove at an upper portion into which said first and second connecting protrusions are inserted, and having a guide slit at a lower portion into which said guide rail is inserted.

4. An apparatus for dispersing a washing water of a dishwasher as claimed in claim 3, wherein said means further comprises a plurality of balls for reducing friction between the guide slit and the guide rail while said balls move along said guide rail.

5. An apparatus for dispersing a washing water of a dishwasher comprising:

a dispersing nozzle arm including a connecting conduit rotatably connected to a pump for supplying a washing water, a plurality of dispersing apertures which are formed on an outer circumference surface thereof and arranged in a longitudinal direction thereof, both ends of said dispersing nozzle arm being opened so that the washing water is dispersed through the dispersing apertures;

a first nozzle body, into which an end of said dispersing nozzle arm is inserted, including a plurality of first assistance spray apertures formed on an outer circumference surface thereof, a first connecting protrusion opposite to the first assistance spray apertures, and a first jet aperture formed on the outer circumference surface between the first assistance spray apertures so that the washing water is ejected from the first jet aperture and the ejection of the washing water rotates said dispersing nozzle arm, said first nozzle body sliding on the outer circumference surface of said dispersing nozzle arm;

a second nozzle body, into which other end of said dispersing nozzle arm is inserted, including a plurality of second assistance spray apertures formed on an outer circumference surface thereof, a second connecting protrusion opposite to the second assistance spray apertures, and a second jet aperture formed on the outer circumference surface between the second assistance spray apertures so that the washing water is ejected from the second jet aperture and the ejection of the washing water from the second jet aperture rotates said dispersing nozzle arm in cooperation with the ejection of the washing water from the first jet aperture, said second nozzle body sliding along on the outer circumference surface of said dispersing nozzle arm, the first and second jet apertures being formed in opposite directions with respect to each other as to spray the washing water in opposite directions;

a guiding part for sliding said first and second nozzle bodies along the outer circumference surface in the lengthwise direction of said dispersing nozzle arm when said dispersing nozzle arm rotates, said means being installed on a bottom wall of said dishwasher and including:

a guide rail installed on the bottom wall of said dishwasher;

a pair of followers for sliding said first and second nozzle bodies along the outer circumference surface of said dispersing nozzle arm while moving along said guide rail, and having a guide slit into which said guide rail is inserted and a connecting groove into which said first and second nozzle bodies are respectively inserted, the guide slits being formed at an upper portion of said followers and the connecting grooves being formed at a lower portion of said followers; and a plurality of balls for reducing friction between the guide slit and the guide rail while said balls move along said guide rail.

* * * * *